United States Patent [19]

Milles

[11] Patent Number: 4,487,043

[45] Date of Patent: Dec. 11, 1984

[54] PERMUTATION LOCK

[75] Inventor: Peter Milles, Alberthofen, Fed. Rep. of Germany

[73] Assignee: S. Franzen Söhne (GmbH & Co.), Solingen, Fed. Rep. of Germany

[21] Appl. No.: 204,397

[22] Filed: Nov. 6, 1980

[30] Foreign Application Priority Data

Nov. 15, 1979 [DE] Fed. Rep. of Germany ..... 2946091

[51] Int. Cl.[3] ..... E05B 37/02

[52] U.S. Cl. ..... 70/312; 70/316

[58] Field of Search ..... 70/67-76, 70/311-312, 315-318

[56] References Cited

U.S. PATENT DOCUMENTS

| | | | |
|---|---|---|---|
| 2,163,852 | 6/1939 | Pond | 70/317 |
| 3,543,545 | 12/1970 | Budzyn | 70/312 |
| 3,633,388 | 1/1972 | Atkinson | 70/312 |
| 3,766,758 | 10/1973 | Heine | 70/318 |
| 4,048,821 | 9/1977 | Bako | 70/316 |
| 4,123,923 | 11/1978 | Bako | 70/316 |

*Primary Examiner*—Robert L. Wolfe
*Attorney, Agent, or Firm*—Martin A. Farber

[57] ABSTRACT

A combination lock having setting discs which are arranged alongside of each other on a shaft, are turnable independently of each other and extend through slots in a front plate of a lock case, having locking sleeves associated with the setting discs, seated on the shaft, in spring-biased coupling engagement with the setting discs and formed on their periphery with depressions which, when the combination number is correctly set are located in a position opposite projections, and having an actuating handle arranged on the front plate, which handle can be displaced longitudinally from its basic position in order to release a hasp which extends into inside of the lock through an opening in the front plate and cooperates with a latch member, the actuating handle also serving to displace the locking sleeves out of their position of coupling engagement with the setting discs. The actuating handle can be displaced from its basic position in a direction opposite the direction of opening of the lock, and thereby pushes the locking sleeves out of their position of engagement.

10 Claims, 11 Drawing Figures

FIG. 7
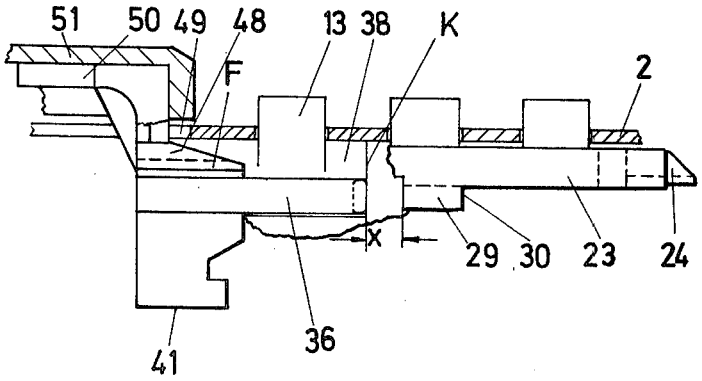
FIG. 8
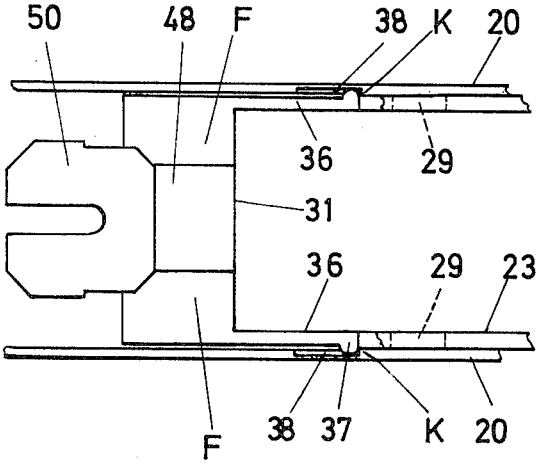
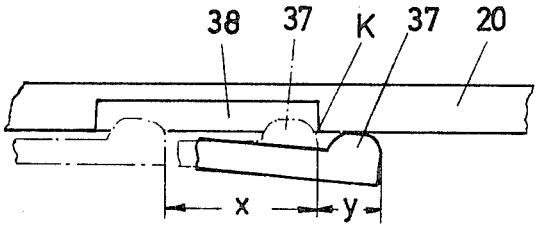
FIG. 9
FIG. 10
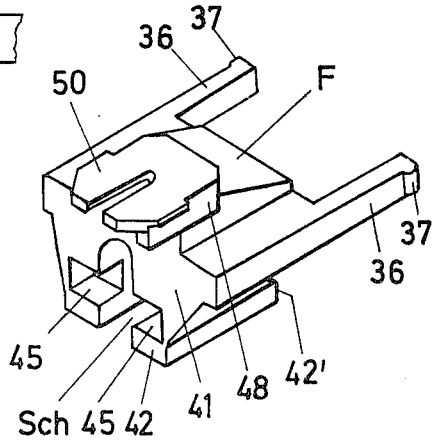

PERMUTATION LOCK

BACKGROUND OF THE INVENTION

The present invention relates to a permutation lock having setting disks which are arranged alongside of each other on a shaft, are turnable independently of each other and extend through slots in a front plate of a lock case, with which disks there are associated locking sleeves which are also seated on the shaft and which are in spring-loaded coupling engagement with the setting disks and are provided on their periphery with depressions which, when the combination number is correctly set, are located opposite projections, the lock having an actuating handle arranged on the front plate, which handle can be displaced longitudinally from its basic position in order to release a hasp which extends into the inside of the lock through an opening in the front plate and cooperates with a latch member, the actuating handle also serving to displace the locking sleeves out of their position of engagement with the setting disks.

DESCRIPTION OF THE PRIOR ART

One construction of this type is known from West German OS No. 28 16 073. In that case, to be sure, recoding is effected via the handle which effects the opening, but the mechanism employed requires a special stop device which separates the normal opening stroke from the recoding stroke which adjoins it in the same direction. The structural means are relatively extensive. Operation is also inconvenient since the actuating lever for the stop device which is arranged within the region of the head of the latch lies in a difficultly accessible position in the opening for the hasp-lug of the lock. The actual grip surface of the lever is too small. This is due to the fact that the lever when struck by the hasp, must still enter into a concealed position within the opening in order to make unauthorized access difficult.

SUMMARY OF THE INVENTION

The object of the present invention is in particular—i.e. in addition to other purposes obtained from the specification and claims—to remedy this situation and to develop a permutation lock of this type in a manner which is simple to manufacture and easy to use, in such a way that a separately released stop mechanism can be done away with but nevertheless, while retaining the normal manner of actuation with respect to the opening, a clear separation of the strokes for the different functions (opening actuation, coding actuation) is obtained.

In accordance with the invention the actuating handle (B) can be displaced from its basic position in a direction opposite the direction of opening of the lock, and thereby pushes the locking sleeves (6) out of their position of engagement.

As a result of this formation, a permutation lock of the above-mentioned type which is of increased utilitarian value is created. Recoding is simplified. The interposing of a separate stop device is dispensed with but the opening and coding strokes are nevertheless clearly separated from each other since, for recoding, the actuating handle is moved out of its basic position in a direction opposite the lock-opening direction. The directions of stroke are opposite to each other. Upon the corresponding displacement, the locking sleeves are displaced from their position of engagement with the setting disks. When they are disengaged, the setting disks can be turned and brought to a new combination. Due to the fact that the basic position is present as a detent-determined intermediate position, a very definitely intended release is required in a corresponding ready position of the lock. The structural means for this purpose are also kept very simple: Thus, by means of a finger which extends into the inside of the lock the actuating handle passes, with a clearance corresponding to the required total stroke, through an opening in the latch member, which is formed as a latch slide, the finger forming, in the region around the shaft, an abutment surface which comes against the locking sleeve located furthermost to the outside. In order to make the movement of displacement of the actuating handle dependent on the unlocked basic position of the lock, it is also provided that the finger is continued, beyond the abutment surface, by a T-shaped extension which is disposed in crossing position with respect to a blocking member, the projections of the latter sensing the depressions of the locking sleeve, said extension also having a blocking shoulder which lies in front of a mating shoulder of the blocking member if the combination has been incorrectly set. The crosswise arrangement leads to an optimum utilization of the space, so that the structural height of the lock can be kept small. Advantages are also present from a functional standpoint inasmuch as the end of the blocking member which forms the mating shoulder lies in the direct vicinity of the inner wall of the lock housing, at least when the code has been incorrectly set. In this way a favorable support on the housing side can be employed for the locking member when load is acting on it. Due to the further structural measure that the finger carries the latch slide along in the opening direction and the lock closing spring acts on the latch slide, the other end of the spring resting against the housing wall of the lock, there is a free passageway between the finger and the latch slide, the latter in this way being given a true hasp function. The locking sleeves are spring biased in the opposing direction. The construction with respect to this is so selected that the housing wall of the lock which is opposite the closure spring of the lock is continued into a spring finger which acts on the locking sleeves from there. When the lock housing is made of plastic the spring finger can be formed at the same time thereon so that a reduction in the number of parts is in this way also possible. The blocking member is formed as a spring-biased single-arm rocker lever with window-shaped openings. It is suitably pivoted laterally in the vicinity of the bottom of the box. The further formation is such that the rocker lever passes into a T-shaped extension lying in the longitudinal direction of the lock, the inner surfaces of the T-arm thereof forming the mating shoulders. This T-shaped extension engages into the extension of the finger. The latter is for this purpose fork-shaped in its region of crossing the blocking member. The fork shape also has the advantage that the actuating handle can be simply placed transversely on the shaft, in a straddle-like arrangement. The shaft which is provided with the locking sleeves and setting disks can therefore be previously mounted in the lock housing. The finger forms lateral tongues which project beyond the abutment surface. The tongues are guided on the corresponding housing walls of the lock. Each of the tongue ends engages by a projection nose into a detent-recess on the wall side of the lock. The latch slide is limited in the direction of opening by stop lugs which terminate in the basic position of the lock at a distance in front of the tongues which corresponds to the opening stroke. In this way the latch slide, upon operation, pushes the finger back out of the coding position even if the finger were held in the coding position via detents. In structural respects, finally, there is also the advantageous feature that the rocker lever is formed symmetrically relative to the longitudinal central plane and acts centrally on the T-shaped extension. The corresponding ward can thereby be used for clockwise-closing and counterclockwise-closing locks.

Further advantages and details of the object of the invention are explained in further detail below with reference to an illustrative preferred embodiment shown in the drawing, in which:

BRIEF DESCRIPTION OF THE DRAWINGS

FIG. 7 shows a side view by itself of an actuating handle which continues to form a finger which displaces the locking sleeves, FIG. 8 is a top view thereof, FIG. 9 is a motion study of the one tongue of the finger exerting the detent function, FIG. 10 shows the actuating handle in an individual perspective view.

DESCRIPTION OF THE PREFERRED EMBODIMENT

Figures 1, 2, 3:
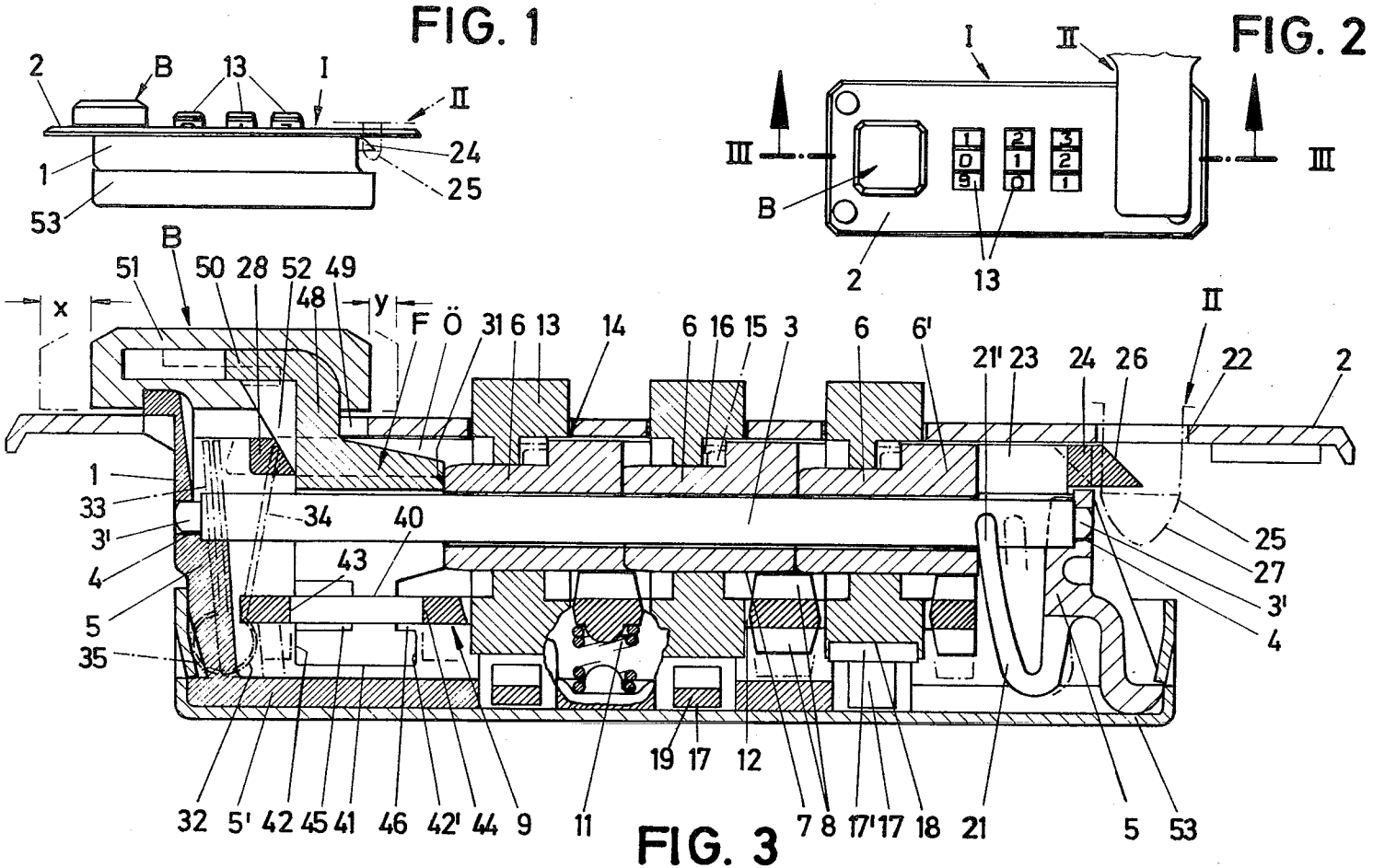
FIG. 1 is a side view of the permutation lock of the invention shown in approximately actual scale.
FIG. 2 is a top view thereof.
FIG. 3 is a section along the line III—III of FIG. 2, on a scale considerably larger than in FIG. 2.
Figure 4:
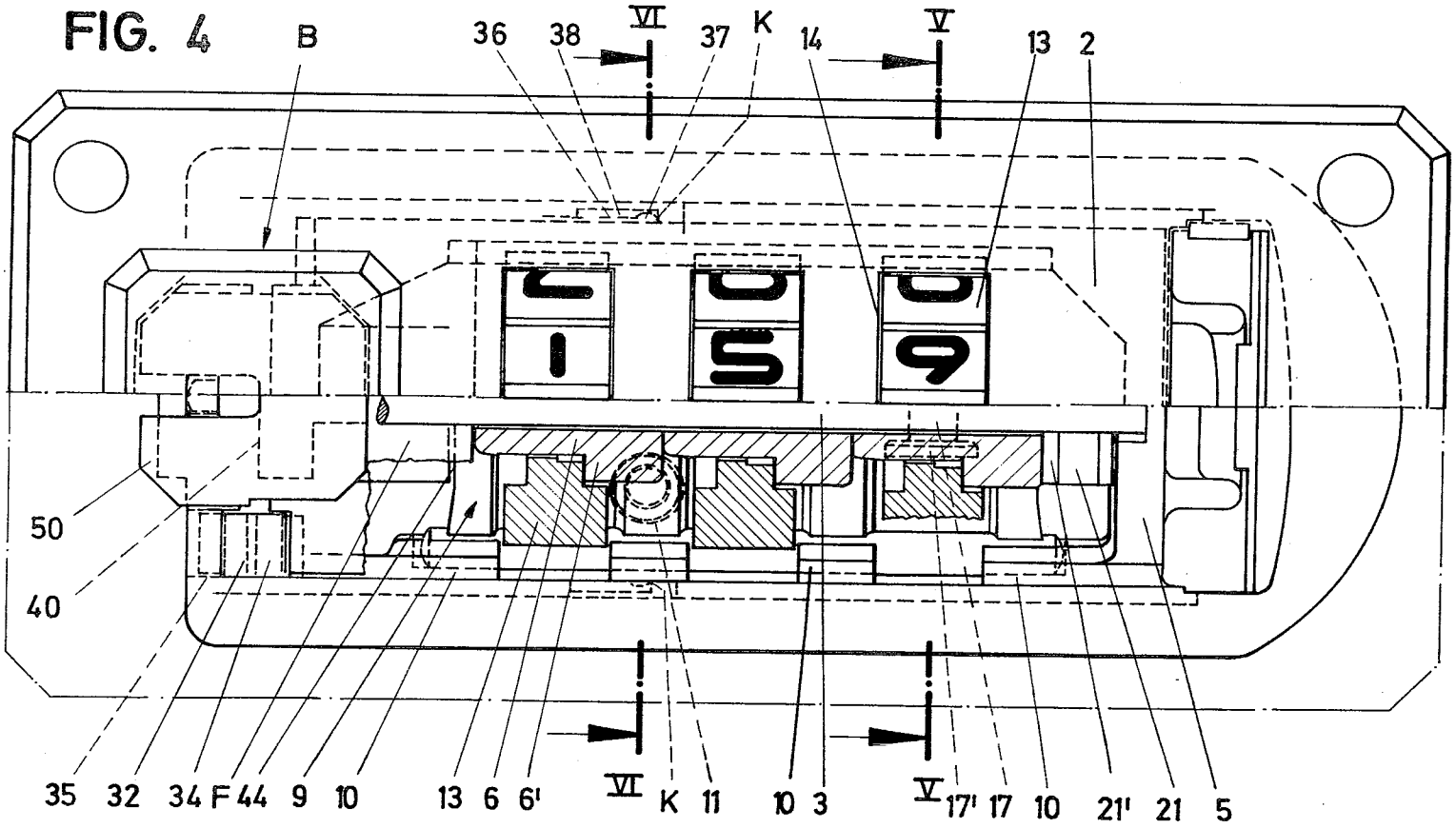
FIG. 4 is a top view of FIG. 3, partially in section.

The lock shown consists of the permutation lock part I proper and a staple closing part a hasp II.

The permutation lock part has a lockcase 1 of elongated shape, preferably formed as a plastic injection molding, which surrounds a lock ward. The lock case at the top adjoins a front plate 2 which is fastened to it and protrudes on all sides beyond the edge of the lock case. The inside of the lock case 1 is traversed in longitudinal direction by a shaft 3. The stepped-down ends 3' of the latter extend into bearing recesses 4 of the lock case 1. The bearing recesses 4 are located in the lock housing walls 5, i.e. the end walls of the lock case 1. The shaft 3 is axially non-displaceable after being clipped in place.

The lock is provided with a blocking and code resetting device. This device comprises, inter alia, several locking sleeves 6. The latter are placed, one behind another, in a row on the shaft 3 and displaceably supported thereon. Each of them has a depression 7 on its periphery, which depressions, when the combination is properly set, are located opposite feeler projection 8 of a blocking member 9 which is arranged in the vicinity of the bottom of the lock case. Reference is had to the perspective view given in FIG. 11. The locking sleeve depression 7 is formed in the embodiment shown by way of example as a trapezoidal notch which is cut somewhat deeper than the height of the locking-sleeve collar 6'.

The blocking member 9 which rests under spring force against the periphery of the locking sleeve is formed as a single-arm rocker lever. It is articulated on a rocker support 10 in the inner side of the lock case. This support lies on the longitudinal side of the lock. The side of the blocking member 9 there is developed in bar shape of circular cross section and is simply clipped into the rocker support 10. The length of the support corresponds to the length of the bar, i.e. the rocker support is closed at its end so that axial displacement is possible only within the customary tolerance range.

As a rocker spring there is employed a helical compression spring 11 which is inserted between lock-housing bottom 5' and the blocking member 9. Both end turns are centered by studs formed on the structural parts. The further formation of the blocking member 9 comprises in the provision of window-shaped openings 12 in the substantially elongated rectangular-shaped plate-like member body. Through these window-shaped openings 12 there extend setting disks 13 which have a partial section seated on the locking sleeves 6. The disks in their basic position are in coupling engagement with the locking sleeves. The discs, for their accessibility for actuating pass through slots 14 of the front plate, 2 which lie opposite the blocking member 9. The coupling engagement is effected via engagement projections 15 which are formed on the locking sleeves 6 and engage into recesses 16 of an inner toothing of the setting disks 13. In the embodiment shown by way of example the locking sleeves have a total of four such engagement projections.

Figure 5:
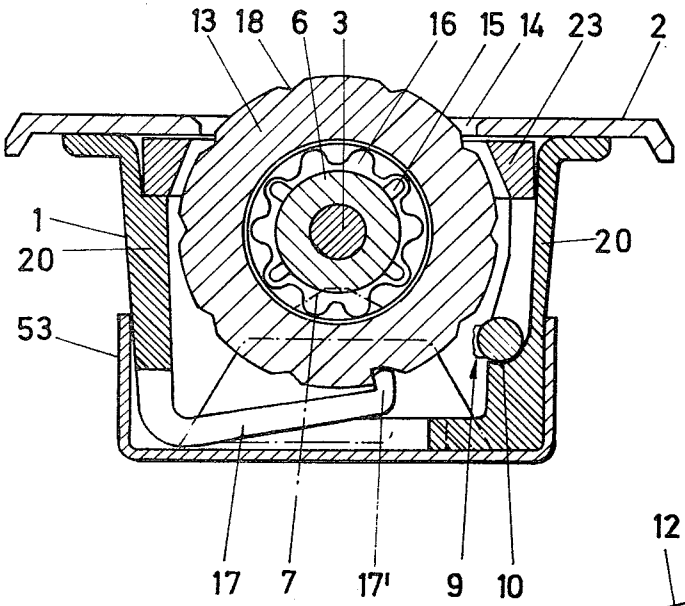
FIG. 5 is a section along the line V—V of FIG. 4.

The setting disks 13 are provided on their periphery with symbols, for instance in the form of numbers, with which an index line on the front plate 2 can be associated (not shown). The specific angular positions of the locking sleeves 6 and setting disks 13, respectively, are secured in position by special springs 17. The detent heads 17' of these springs enter into notch-like detent depressions 18 distributed at equal angles on the edge surfaces of the setting disks 13 (see FIG. 5). The springs are formed in the shape of freely cut arms 19 of the lock case 1. These arms comprise a section of the lock-housing bottom 5' and a part of the longitudinal wall 20 of the lock case 1 in which they commence. This is the opposite longitudinal wall 20 which lies opposite the longitudinal wall 20 which forms the rocker bearing 10.

Not only the springs 17 but also the spring which holds the locking sleeves 6 and setting disks 13 in engagement with each other are made of the material of the lock case. This last-mentioned spring is formed as spring finger 21 extending from the lock-housing wall 5 which is on the hasp side, namely the end wall. This finger extends from the zone below the bearing recess 4 and continues over a bottom-side swept-back section in the direction towards the front plate. The end 21' of the spring finger is forked and by its tine ends created in this manner engages on both sides of the cross section of the shaft to the hasp-side end surface of the locking sleeve 6.

The support of the aligned locking sleeves 6 can be effected at the setting disks 13, which is their turn are held in axially non-displaceable manner by the slots 14. The recesses in the setting disks 13 are closed in the direction of actuation.

The disengagement of the locking sleeves 6 is effected by means of the actuating handle B. The latter thus has a two-fold function since it normally serves to release the hasp II which engages through an opening 22 in the front plate 2 into the inside of the lock, pulling back, against spring action, a latch member which is supported for longitudinal displacement below the front plate 2 and which is formed as latch slide 23. The latch slide 23 has a frame-like shape. The arm of the frame on the hasp side continues into a latch projection 24. The latter snaps, in the manner of a catch, into the eye 25 of a stapel-shaped hasp II formed with a hasp bevel 26. The bottom side of the eye has a tranverse rounding 27 which can be noted in FIG. 3. When this transverse rounding 27 strikes against the hasp bevel 26 the latch projection 24 is pushed back against the spring force of spring 39 acting on the latch slide 23 without the actuating handle B being correspondingly displaced.

The corresponding free mobility is obtained in the manner that a finger F which extends from the actuating handle B towards the inside of the lock is not seated rigidly on the frame of the latch slide 23 but rather passes through the latter, even with clearance. The frame opening of the latch slide is designated Ö. A transverse arm 28 of the latch slide 23, located on the side of the actuating-handle B, lies against the finger F under spring biasing. The latch slide 23 itself is supported in its basic position on the housing side. For this purpose stop lugs 29 extend from the bottom of the longitudinal arms of the frame of the latch slide 23, said lugs passing in front of a shoulder 30 in the longitudinal walls 20 of the lock case 1 (see FIG. 7).

For the disengagement of the locking sleeves, the finger F forms on the said facing toward the hasp in the region around the shaft 3 an abutment surface 31 which comes against the outermost locking sleeve 6, i.e. the locking sleeve lying on the side of the actuating handle. The corresponding basic position (FIG. 3) is formed as a detented intermediate position of the actuating handle and finger F, respectively, held between the end locking sleeve 6 and the transverse arm 28 of the frame of the latch slide 23. From this basic position, a leftward displacement of the actuating handle 13, if the code is correctly set, effects an opening of the lock with the retraction of the latch projection 24 from the eye 25. The corresponding opening stroke path is designated x in FIG. 3.

A displacement of the actuating handle B and thus of the finger F, i.e. to the right from the basic position, effects the elimination of the coupling engagement between the locking sleeves 6 and the setting disks 13, so that recoding can then be effected. The coding stroke is designated y in FIG. 3.

The moving decoupling of the locking sleeves 6 is effected against the force of the spring finger 21 which acts upon them. The disengaged position is indicated in dash-dot line on the hasp-side end of the lock in FIG. 3.

The displacement motion of the actuating handle B in the direction for the opening of the lock takes place against the greater force of the lock closure spring 32. This is a U-bent spring leaf, one arm 33 of which rests against the lock housing wall 5, i.e. the one end wall of the lock case 1, while the other arm 34 acts on the latch slide 23. The U reversal, as can be noted from FIG. 3, is of clearly rounded formation, a part of this rounding being anchored in a notch 35 on the bottom side of the lock case 1. The lock closure spring 32 can thus be simply arranged in the manner of a plug-in connection.

The basic position of the detented intermediate position is obtained by providing the finger F with lateral tongues 36 which project beyond the abutment surface 31. These tongues are formed on the finger. Each of the tongue ends continues into a detent projection 37. The detent projections project outwardly and engage into a detent recess 38. The detent recess 38 is formed in the shape of a notch on the inner side of the lock case 1, the transverse depth of the notch corresponding to about one-half the wall thickness of the lock case. It extends from the edge of the lock case and terminates on the bottom side at the same height as the bottom of the shaft 3. As can be clearly noted from FIG. 9, the notch is of such a width that the detent projections 37 can move freely while performing the opening stroke x. Only the starting of the coding stroke y is effected against a clear detent resistance on the hasp-side notch edge K of the detent recess 38. This and the force of the spring finger 21 prevent the coupling engagement between the locking sleeves 6 and setting disks 13 from being accidentally interrupted by accidental contacts and under the assumption of the corresponding coding-readiness position established on the lock side.

The corresponding disengagement can also be developed as a detent position so that during recoding it is not necessary to hold the actuating handle and thus the finger F fast. If in such case the further formation is such that in the closed position of the latch slide 23 its stop lugs 29 terminate at a distance in front of the tongues 36 which corresponds to the opening stroke x (FIG. 7) as a result of which therefore the hasp function is not impaired, the coding-readiness position would be automatically eliminated when the hasp II snaps into the closing position as a result of the catch action of the latch slide 23. The stop lug 29 would namely push the finger back so that the detent projections 37 are again in the detent depression 38.

Both strokes of the finger F can be effected only as a function of the correct opening position of the blocking member 9. The latter has, for this purpose, a T-shaped extension 40.

Figure 11:
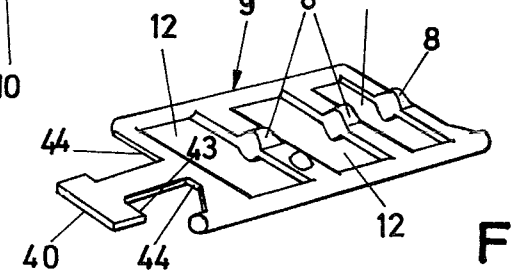
FIG. 11 shows the locking member formed as rocker lever, in an individual perspective view.

The T-shaped extension acts centrally of the ladder-shaped base body of the rocker lever; see FIG. 11. It extends symmetrically in the longitudinal central plane so that the rocker lever, i.e. the blocking member 9, can be inserted optionally for clockwise closing or counter-clockwise closing locks. The feeler projections 8 are also provided correspondingly on both sides. The same applies with respect to the bosses which secure the helical compression spring 11.

Figure 6:
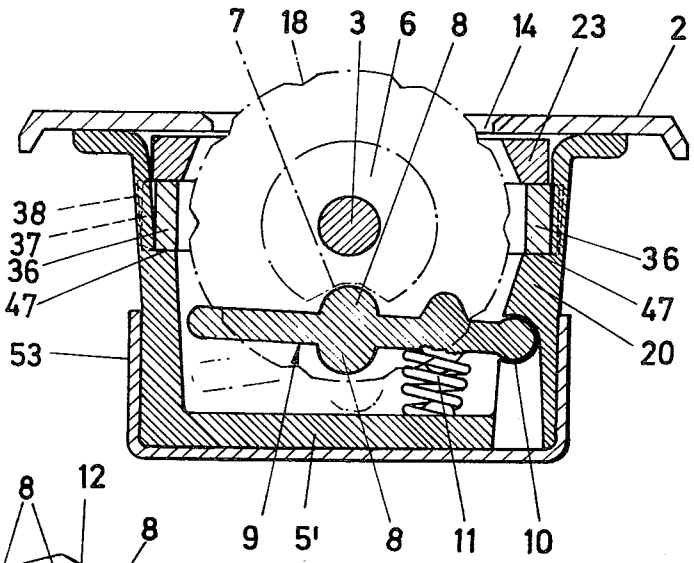
FIG. 6 is a section along the line VI—VI of FIG. 4.

The finger F forms a T-shaped extension 41 which extends downwardly beyond the abutment surface 31. The extension extends in cross-wise position to the blocking member 9, the feeler projections 8 of which sense the depressions 7 of the locking sleeves 6 (cf. FIG. 6). The end surface of the T-arm of the finger F which faces the lock housing wall 5 there forms a blocking shoulder 42. If the combination is incorrectly set, the latter cooperates with a mating shoulder 43 of the blocking member. The corresponding situation is shown in dash-dot lines in FIG. 3 (cf. the dot-dash lines in FIG. 6). The tilted position of the blocking member 9 close to the bottom occurs when at least one of the feeler projections 8 of the blocking member is prevented, from entering into the depression 7 of a setting disk 13, thus rests against the further outwardly disposed blocking-sleeve collar 6'. In this blocking position which is shown in dot-dash lines a displacement of the actuating handle B to perform the opening stroke x would be out of the question. Due to the fact that in this connection also the end of the blocking member 9 which forms the mating shoulder 43 lies, at least when the combination is improperly set, in the inner wall of the direct vicinity of the lock-housing there, an active lock-case side supporting of the blocking member 9 can be utilized, as a result of which the blocking member is maintained free of greater loads. However, the coding stroke y can also not be carried out in this position since namely the other end surface 42' of the T-arm of the T-shaped extension 41, i.e. the end surface facing towards the hasp, would come against a second mating shoulder 44 of the blocking member 9, which second shoulder, in view of the T shape of the extension 40 selected, is present due to the notches obtained thereby.

As a result of the different lengths of stroke between the opening stroke and the coding stroke, the cross arm of the T-shaped extension 41 is not seated symmetrically but rather eccentrically (see FIG. 3), so that a deeper insertion notch 45 for the opening stroke is present and a shallower insertion notch 46 is reserved for the coding stroke.

The crosswise interengagement of the structural parts which control the coding-readiness position is reached in the manner that the extension 41 of the finger F is of fork shape in its region of crossing with respect to the blocking member 9. The fork shape can be clearly noted from FIG. 10. The fork slot Sch which is open on the lock-bottom side permits the lateral insertion of the formed part shown in this figure onto the shaft 3. The notches 45 are closed on the lateral outside, particularly for reasons of stability and also furthermore for reasons of dependable removal from the mold.

The shaft 3 can also be used as additional means of guidance for the stradling finger F. Otherwise the finger which is formed as a slide is guided together with the bottom side of the tongues 36 on a slide track 47 formed by a reduction in cross section of the longitudinal walls 20 (see FIG. 6). Lying on these tongues 36, the latch slide 23 is also guided over a portion of its length.

On the side of the front plate the finger F passes into an upwardly directed neck 48 which passes through the opening Ö of the latch slide 23 and an opening 49 of the front plate. The neck terminates with a split support plate, formed thereon, for an actuating cap 51 which is held fast in the way of the clip arrangement. The bent, freely extending section of the plate 50 is supported by a strut 52 having a reinforcing action which is formed thereon in the region of the inner corner.

The lock case is sufficiently stable in itself but may furthermore be provided with a shell-like metal covering 53 which is clipped on at the bottom. It would have the advantage of covering the openings present as a result of the cutting free of the spring fingers 17.

I claim:

1. In a combination lock having setting discs which are arranged alongside of each other on a shaft, are turnable independently of each other and extend through slots in a front plate of a lock case, having a plurality of aligned locking sleeves associated with the setting discs, seated on the shaft and in spring-biased coupling engagement with the setting discs and formed on their periphery with depressions which, when the combination number is correctly set, are located in a position opposite projections, and having an actuating handle arranged on the front plate, which handle can be displaced longitudinally from a basic position thereof in a direction toward an opening position of the lock in order to release a hasp which extends into inside of the lock case through an opening in the front plate and cooperates with a latch member, the actuating handle also for operatively displacing the locking sleeves out of their position of coupling engagement with the setting discs, the improvement comprising said actuating handle is mounted displaceably from said basic position thereof in a displacement movement in a direction opposite the direction toward said opening position of the lock and constitutes means during said displacement movement for pushing the locking sleeves out of said position of coupling engagement, detent means for holding said actuating handle in said basic position as a detented intermediate position thereof, said latch member constitutes a latch slide formed with an opening, a finger extends towards the inside of said lock case and passes with clearance through said opening of said latch slide, said finger is operatively moveably connected to said actuating handle, said finger extends inside said lock case in a vicinity around said shaft and in said vicinity forms an abutment surface engaging against an endmost of said locking sleeves.

2. The combination lock according to claim 1, wherein said finger extends beyond said abutment surface into a T-shaped extension formed with a blocking shoulder, a blocking member is formed with a mating shoulder and a plurality of said projections, the latter being adjacent said locking sleeves, respectively, said locking sleeves each are formed with one of said depressions, respectively, alignable facing said projections of said blocking member, respectively, when said locking sleeves are rotated in a proper respective position, said T-shaped extension of said finger is disposed in crosswise position to said blocking member, said blocking member is moveably mounted such that when all of said locking sleeves are in a proper respective position when the combination is properly set and all said projections enter all said depressions, respectively, said mating shoulder of said blocking member is out of a path of movement of said blocking shoulder of said finger and when the combination is incorrectly set said blocking shoulder of said finger lies in front of said mating shoulder of said blocking member so as to prevent a corresponding displacement movement of said actuating handle by said finger.

3. The combination lock according to claim 2, wherein said lock case has an inner wall defining the inside of said lock, said mating shoulder of said blocking member is formed adjacent an end of said blocking member, said end is disposed directly adjacent said inner wall of said lock case when at least one of said projections does not engage in at least one of said depressions in one of said locking sleeves when the combination is incorrectly set.

4. The combination lock according to claim 1, wherein said lock has an inner wall defining the inside of said lock, said finger moveably abuts said latch slide so as to move the latch slide along therewith when said actuating handle moves said finger and in said direction toward the opening position of the lock, said detent means includes a lock closing spring means for biasing said latch slide in a direction toward closing said lock, said spring means has one end engaging against said latch slide and another end engaging against an adjacent portion of the inner wall of said lock case.

5. The combination lock according to claim 4, wherein said inner wall of said lock case has another portion remotely opposite said locking closing spring means, said another portion of said inner wall is formed into a spring finger means for biasing said locking sleeves in a direction opposite to the biasing of said lock closing spring means, said spring finger means and said lock closing spring means constitute part of said said detent means in cooperation with said locking sleeves and said latch slide respectively acting on said finger.

6. The combination lock according to claim 2, wherein said blocking member is pivotally mounted in said lock case and constitutes a single-arm rocker lever, said rocker-lever defines window-shaped openings, said setting discs pass through said window-shaped openings, respectively, said rocker lever is formed with a T-shaped extension portion extending in a longitudinal direction of the lock case, said T-shaped extension portion forms facing surfaces, one of said facing surfaces constitutes said mating shoulder and another of said facing surfaces constitutes another mating shoulder, the latter cooperating with an end surface of said T-shaped extension of said finger adjacent thereto when said finger is moved in a direction thereagainst by said actuating handle when the combination is improperly set.

7. The combination lock according to claim 2, wherein said T-shaped extension of said finger has a fork shape in a vinicity of crossing said blocking member.

8. The combination lock according to claim 1 or 5, wherein said detent means includes, said finger is formed with lateral tongues projecting longitudinally beyond said abutment surface, each of said tongues is formed with an end having a separate detent projection, said lock case is formed with longitudinal side walls formed with detent recesses on the inside of said lock case, said detent projections of said ends of said tongues, respectively, slideably engage in said detent recesses formed on said longitudinal side walls, respectively.

9. The combination lock according to claim 8, wherein said latch slide is formed with stop lugs, spaced apart from said tongues, respectively, in said basic position of said actuating handle by a distance corresponding to an opening stroke of said latch slide upon movement of the latter into its opening position, said stop lugs constitute means for abutting said tongues and limiting displacement movement of said latch slide in its direction of opening.

10. The combination lock according to claim 6, wherein said rocker lever is formed symetrically to a longitudinal central plane and said T-shaped extension portion of said rocker lever is arranged centrally thereto.

* * * * *